US009873969B2

(12) United States Patent
Erickson et al.

(10) Patent No.: US 9,873,969 B2
(45) **Date of Patent: *Jan. 23, 2018**

(54) WASHING MACHINE HAVING AN EXOSKELETON

(71) Applicant: Whirlpool Corporation, Benton Harbor, MI (US)

(72) Inventors: Donald E. Erickson, Stevensville, MI (US); George W. Malheiros, Saint Joseph, MI (US); Christoph J. Miller, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 467 days.

This patent is subject to a terminal disclaimer.

(21) Appl. No.: 14/574,461

(22) Filed: Dec. 18, 2014

(65) Prior Publication Data

US 2016/0177487 A1 Jun. 23, 2016

(51) Int. Cl.

*D06F 37/22* (2006.01)
*D06F 37/26* (2006.01)
*D06F 37/20* (2006.01)

(52) U.S. Cl.

CPC ..... *D06F 37/268* (2013.01); *D06F 37/206* (2013.01); *D06F 37/22* (2013.01); *D06F 37/265* (2013.01); *D06F 37/267* (2013.01)

(58) Field of Classification Search

CPC ..... D06F 37/268; D06F 37/22; D06F 37/206; D06F 37/265; D06F 37/267; D06F 37/269

See application file for complete search history.

(56) References Cited

U.S. PATENT DOCUMENTS 2,610,523 A * 9/1952 Kahn ..... D06F 37/225 210/144
3,235,082 A * 2/1966 Compans ..... D06F 37/225 210/138

(Continued)

FOREIGN PATENT DOCUMENTS

DE 102007026130 A1 12/2007
WO WO 2006063305 A1 * 6/2006 ..... D06F 25/00

OTHER PUBLICATIONS

German Search Report for Counterpart DE102015117158.9, dated Jul. 19, 2016.

*Primary Examiner* — Joseph L Perrin
*Assistant Examiner* — Irina Graf

(57) ABSTRACT

A laundry treating appliance configured to treat laundry according to a treating cycle of operation includes a chassis that defines an interior and a tub statically mounted to the chassis, and at least one suspension opening in a side of the tub. An exoskeleton is located within the liquid chamber and has a front support, a rear support, and stringers extending between and connecting the front and rear supports. An electric motor is mounted to the rear support and has a rotating output shaft. A drum is connected to the output shaft and is rotatbly mounted to the exoskeleton. A suspension system is located within the interior and has at least one suspension component extending from the interior and into the liquid chamber through the suspension opening and is operably coupled to the exoskeleton. The suspension system provides suspension directly to the exoskeleton to indirectly provide suspension for the drum and electric motor.

16 Claims, 5 Drawing Sheets

(56) References Cited

U.S. PATENT DOCUMENTS

| | | | | |
|---|---|---|---|---|
| 5,913,951 | A * | 6/1999 | Herr | D06F 37/225 68/23.2 |
| 7,441,422 | B2 * | 10/2008 | Choi | D06F 25/00 366/225 |
| 2004/0244121 | A1 * | 12/2004 | Lim | D06F 23/06 8/159 |
| 2006/0254321 | A1 * | 11/2006 | Lim | D06F 37/225 68/12.01 |
| 2011/0296877 | A1 * | 12/2011 | Song | D06F 37/20 68/139 |
| 2012/0144598 | A1 * | 6/2012 | Ostdiek | D06F 37/225 8/137 |
| 2014/0190219 | A1 * | 7/2014 | Kim | H02K 21/12 68/140 |

* cited by examiner

WASHING MACHINE HAVING AN EXOSKELETON

BACKGROUND OF THE INVENTION

Laundry treating appliances, such as clothes washers, refreshers, and non-aqueous systems, may have a configuration based on a cabinet within which is housed the components of the appliance, including a tub. The tub may house a rotating drum that defines a treating chamber in which laundry items are placed for treating. The tub is dynamically connected to the suspension system to support the drum. The tub is dimensioned to accommodate tub movement within the cabinet, movement of the drum within the tub, and to support forces generated by the weight and rotation of the drum.

BRIEF DESCRIPTION OF THE INVENTION

A laundy treating appliance configured to treat laundry according to a treating cycle of operation. The laundry treating appliance comprises a chassis that defines an interior and has a front and a rear with an access opening located in the front. A tub is statically mounted to the chassis and defines a liquid chamber locatred within the interior and has at least one suspension opening in a side of the tub. An exoskeleton is located within the liquid chamber and has a front support located near the front of the chassis, a rear support located near the rear of the chassis, and stringers extending between and connecting the front and rear supports to collectively form a skeletal frame defining a frame interior. An electric motor is mounted to the rear support and has a rotating output shaft. A drum is located within the liquid chamber and connected to the output shaft such that rotation of the output shaft rotates the drum within the liquid chamber. The drum is rotatably mounted to the exoskeleton. A suspension system is located within the interior and has at least one suspension component extending from the interior and into the liquid chamber through the suspension opening and is operably coupled to the exoskeleton. The suspension system provides suspension directly to the exoskeleton to indirectly provide suspension for the drum and electric motor.

DESCRIPTION OF EMBODIMENTS OF THE INVENTION

Figure 1:
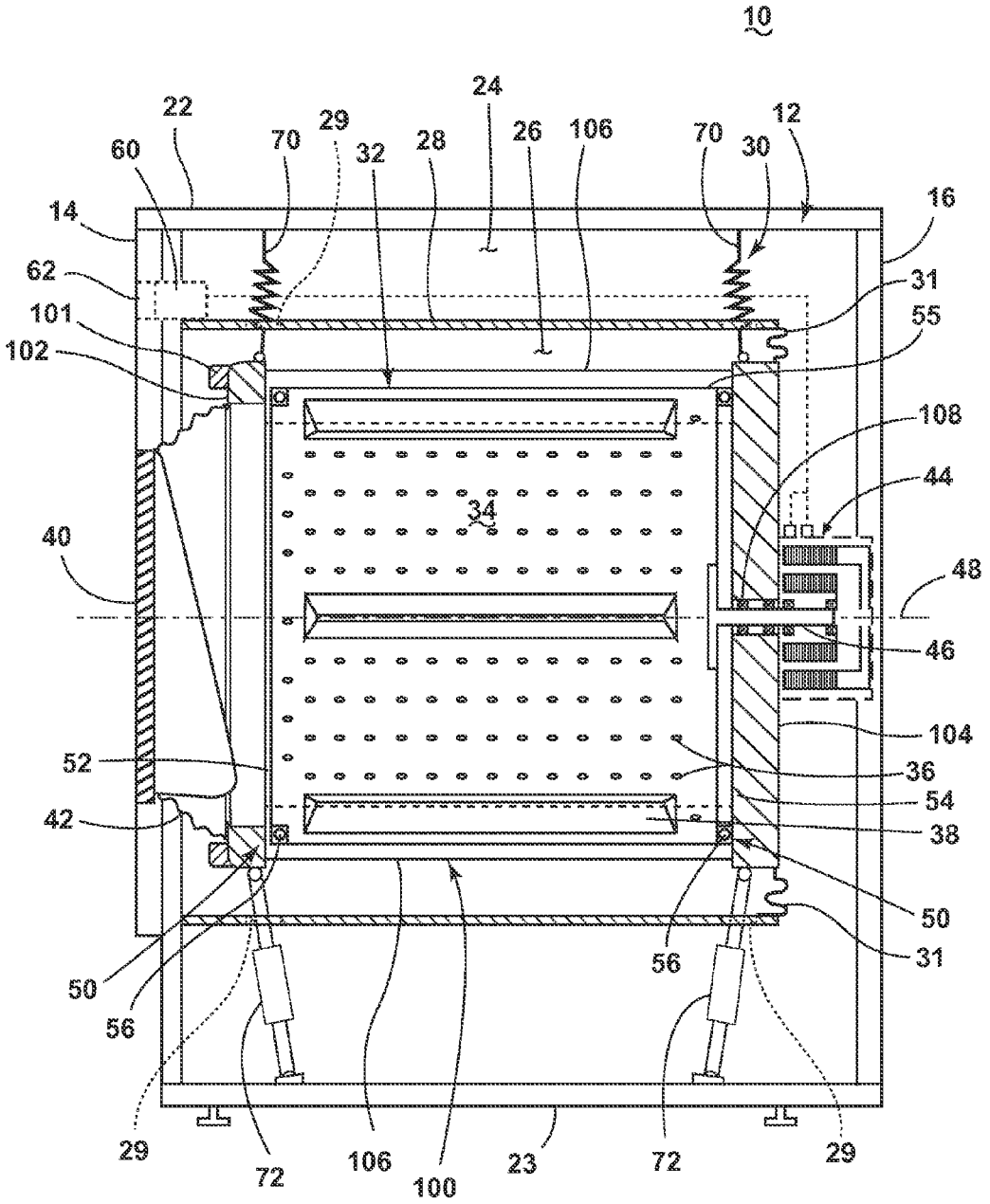
FIG. 1 is a schematic side sectional view of a washing machine according to an embodiment of the invention.

FIG. 1 is a schematic view of a laundry treating appliance according to an embodiment of the invention. The laundry treating appliance may be any appliance which performs a cycle of operation to clean or otherwise treat items placed therein, non-limiting examples of which include a horizontal axis clothes washer; a clothes dryer; a combination washer and dryer; a tumbling or stationary refreshing/revitalizing machine; an extractor; a non-aqueous washing apparatus; and a revitalizing machine. As used herein, the "horizontal axis" washing machine refers to a washing machine having a rotatable drum, perforated or imperforate, that holds fabric items and washes the fabric items by the fabric items rubbing against one another as the drum rotates. In some horizontal axis washing machines, the drum rotates about a horizontal axis generally parallel to a surface that supports the washing machine. However, the rotational axis need not be horizontal. The drum may rotate about an axis inclined relative to the horizontal axis. In horizontal axis washing machines, the clothes are lifted by the rotating drum and then fall in response to gravity to form a tumbling action. Mechanical energy is imparted to the clothes by the tumbling action formed by the repeated lifting and dropping of the clothes.

Figure 2:
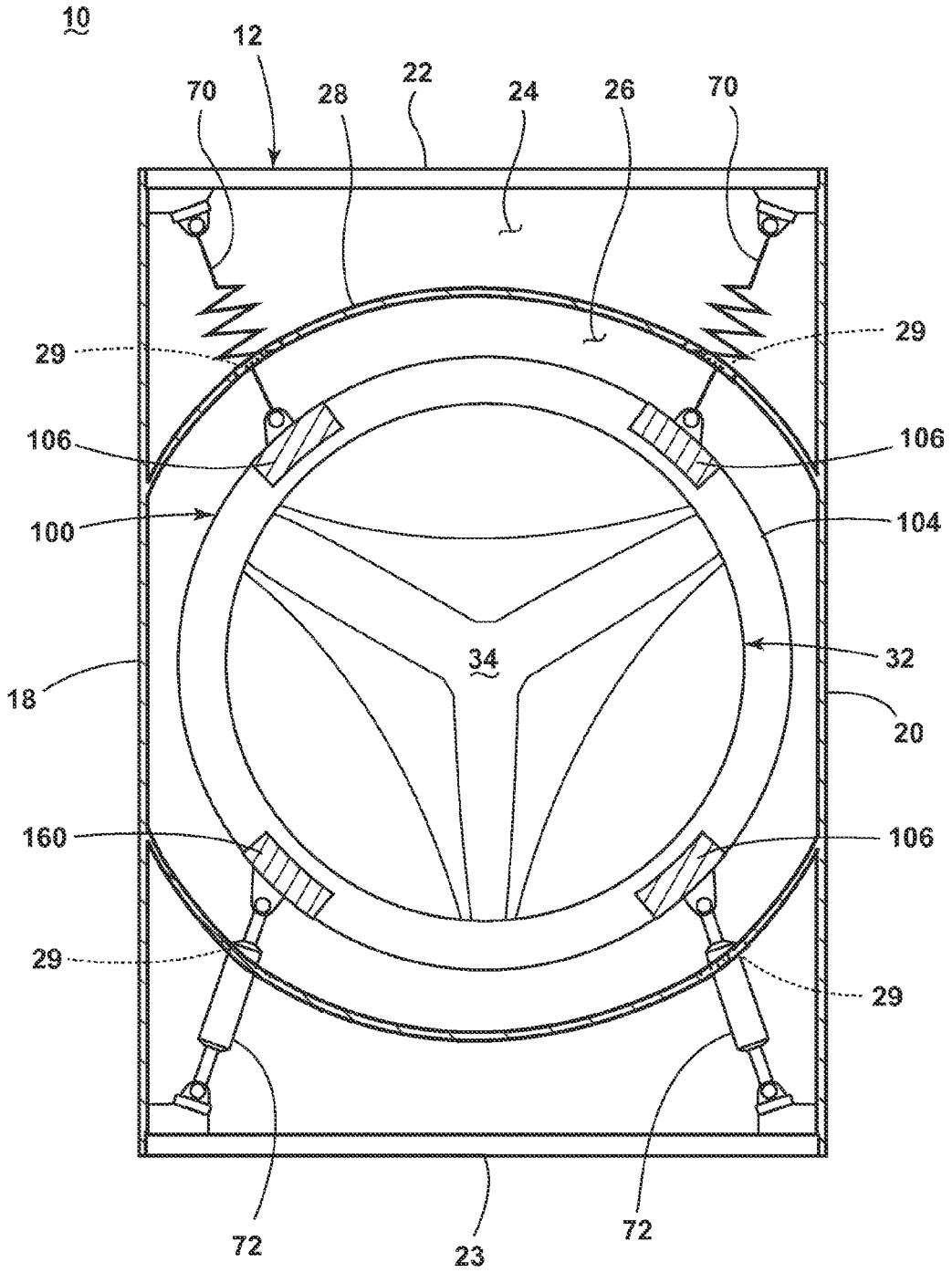
FIG. 2 is a schematic front sectional view of a washing machine according to an embodiment of the invention.

As may best be seen in FIGS. 1 and 2, the laundry treating appliance is illustrated as a washing machine 10, which may include a structural support system comprising a chassis 12 in the form of a frame which may be used to support additional components of the washing machine 10. For example, the chassis 12 may be coupled or integrally formed with panels comprising a front wall 14, a rear wall 16, opposing side walls 18 and 20, an upper wall 22, and a bottom wall 23, which together may form a cabinet enclosing the internal components of the washing machine 10. The panel walls 14, 16, 18, 20, 22, and 23 may be coupled with the chassis 12 using any suitable mechanical or non-mechanical fastener or combination of fasteners, non-limiting examples of which include bolts, screws, snap-fit fasteners, clips, clamps, adhesives, or welds. If the washing machine 10 is a built-in appliance such that one or more sides of the washing machine 10 are encompassed by cabinetry, walls, paneling or furniture at the installation site, one or more of the walls 14, 16, 18, 20, 22, and 23 may not be included. The chassis 12, and optionally the panel walls 14, 16, 18, 20, 22, and 23 may define an interior 24 enclosing components typically found in a conventional washing machine, such as motors, pumps, fluid lines, controls, sensors, transducers, and the like. Such components will not be described further herein except as necessary for a complete understanding of the invention.

A liquid chamber 26 is defined by a tub 28, which is supported by the chassis. The tub 28 is statically mounted to the chassis 12. Alternatively, the tub 28 may be at least partially mounted to the front wall 14 and the opposing side walls 18 and 20. The tub 28 may also be integrally formed with the opposing side walls 18 and 20 as seen in FIG. 2. By statically mounted, it is meant that the tub 28 is not coupled by a suspension system to the chassis. The tub 28 is, thus, statically located relative to the chassis. Such a mount configuration provides for the tub 28 to be mounted directly to the chassis and/or the walls. In addition, portions of the chassis and walls can function as part of the tub 28.

A laundry holding assembly is disposed at least partially within the liquid chamber 26 and is defined by an exoskeleton 100, a drum 32 provided within the exoskeleton 100, and a laundry treating chamber 34 at least partially defined by the drum 32. The exoskeleton 100 physically supports the drum 32 and a suspension system 30 extends between the exoskeleton 100 and the chassis 12 to provide suspension directly to the exoskeleton 100. In turn, the suspension system 30 indirectly provides suspension for the drum 32. The suspension system 30 is configured to reduce the movement and vibration of the laundry holding assembly during a cycle of operation.

The drum 32 may include a plurality of perforations 36 such that liquid may flow between the tub 28 and the drum 32 through the perforations 36. A plurality of baffles 38 may be disposed on an inner surface of the drum 32 to lift the laundry load received in the treating chamber 34 while the drum 32 rotates.

The laundry holding assembly may further include a door 40 which may be movably mounted to the chassis 12 to selectively close the drum 32. A bellows 42 may couple a front opening in the exoskeleton 100 with the chassis 12, with the door 40 sealing against the bellows 42 when the door 40 closes the drum 32.

The washing machine 10 also includes a drive system for rotating the drum 32 and may include an electric motor 44 physically supported by the exoskeleton 100, which is directly coupled with the drum 32 through an output shaft or drive shaft 46 to rotate the drum 32 about a longitudinal axis 48 of the drum 32 during a cycle of operation. The electric motor 44 may be a brushless permanent magnet (BPM) motor having a stator and a rotor. Alternately, the electric motor 44 may be coupled to the drum 32 through a belt and a drive shaft to rotate the drum 32, as is known in the art. Other motors, such as an induction motor or a permanent split capacitor (PSC) motor, may also be used. The electric motor 44 may rotate the drum 32 at various speeds in either rotational direction.

The washing machine 10 may include additional features typically found in a conventional washing machine, the details of which are not germane to the present invention. For example, the washing machine 10 may include a liquid supply system for supplying water to the washing machine 10 for use in treating laundry during a cycle of operation and a dispensing system for dispensing treating chemistry to the treating chamber 34 for use in treating the laundry according to a cycle of operation. The washing machine 10 may also include a recirculation and drain system for recirculating liquid within the laundry holding assembly and draining liquid from the washing machine 10. Liquid supplied to the drum 32 or tub 28 enters a space between the tub 28 and the drum 32 and may flow by gravity to a drain conduit, which may drain the liquid from the washing machine 10, or to a recirculation conduit to direct liquid into the drum 32. In this manner, liquid provided to the drum 32 or tub 28, with or without treating chemistry may be recirculated into the treating chamber 34 for treating the laundry within. The liquid supply and/or recirculation and drain system may be provided with a heating system which may include one or more devices for heating laundry and/or liquid supplied to the drum 32 or tub 28, such as a steam generator and/or a sump heater, the details of which are not germane to the present invention. Any suitable liquid supply system, dispensing system, recirculation system and/or drain system may be used with the embodiments of the present invention, the details of which are not germane to the present invention.

The washing machine 10 also includes a control system for controlling the operation of the washing machine 10 to implement one or more cycles of operation. The control system may include a controller 60 located within the chassis 12 and a user interface 62 that is operably coupled with the controller 60. The user interface 62 may include one or more knobs, dials, switches, displays, touch screens and the like for communicating with the user, such as to receive input and provide output. The user may enter different types of information including, without limitation, cycle selection and cycle parameters, such as cycle options.

The controller 60 may include the machine controller and any additional controllers provided for controlling any of the components of the washing machine 10. For example, the controller 60 may include the machine controller and a motor controller. Many known types of controllers may be used for the controller 60. The specific type of controller is not germane to the invention. It is contemplated that the controller 60 is a microprocessor-based controller that implements control software and sends/receives one or more electrical signals to/from each of the various working components to affect the control software. As an example, proportional control (P), proportional integral control (PI), and proportional derivative control (PD), or a combination thereof, a proportional integral derivative control (PID control), may be used to control the various components. The controller 60 may be provided with a memory for storing control software that is executed by a central processing unit of the controller 60 in completing a cycle of operation using the washing machine 10 and any additional software.

The controller 60 may be operably coupled with one or more components of the washing machine 10 for communicating with and controlling the operation of the component to complete a cycle of operation. For example, the controller 60 may be operably coupled with the electric motor 44 and any other additional components that may be present such as a steam generator, a treating chemistry dispenser, and a sump heater (not shown) to control the operation of these and other components to implement one or more of the cycles of operation. The controller 60 may also be coupled with one or more sensors provided in one or more of the systems of the washing machine 10 to receive input from the sensors, which are known in the art and not shown for simplicity. Non-limiting examples of sensors that may be communicably coupled with the controller 60 include: a treating chamber temperature sensor, a moisture sensor, a weight sensor, a chemical sensor, an optical sensor, a conductivity sensor, a turbidity sensor, a position sensor and a motor torque sensor, which may be used to determine a variety of system, laundry and liquid characteristics, such as laundry load inertia or mass.

Figure 3:
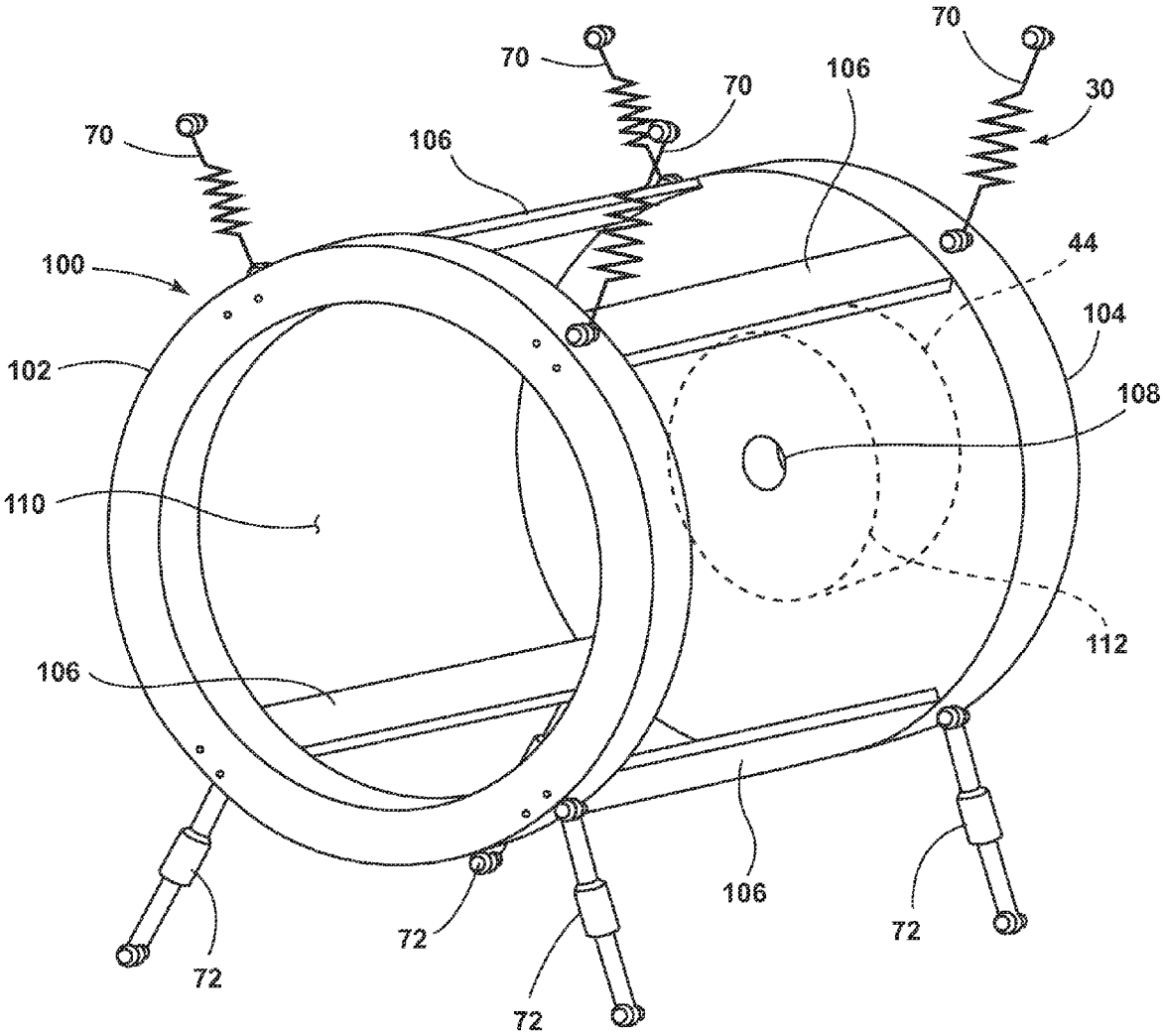
FIG. 3 is a perspective view of a washing machine according to an embodiment of the invention.

FIG. 3 better illustrates the exoskeleton 100 and the suspension system 30 coupled thereto. The exoskeleton 100 comprises a front support 102, a rear support 104, and at least two stringers 106 extending between the front support 102 and rear support 104. The front support 102 forms a substantially annular ring having a central opening 110 to provide access to the drum. The rear support 104 forms a substantially annular disc having a bearing mount 108 defining a shaft passage and a motor mount 112 formed on the rear side of the rear support 104. The stringers 106 comprises an elongated structure that forms a cross support between the front support 102 and rear support 104 to rigidly connect the front support 102 to the rear support 104. The stringers 106 may be attached to the front support 102 and rear support 104 by commonly known fastening devices or fastening methods well known in the art including but not limited to screws, rivets, clamps, and welds. Alternatively, the front support 102, a rear support 104, and stringers 106 may be integrally formed.

The suspension system 30 comprises at least two springs 70 and at least two struts or dampers 72 attached to the front support 102 and rear support 104 of the exoskeleton 100. As illustrated, two springs 70 are attached to the upper portion of both the front support 102 and rear support 104 and two dampers 72 attached to the lower portion of both the front support 102 and rear support 104. Alternatively, the springs 70 and dampers 72 may attach to the stringers 106 or a combination of the front support 102, rear support 104 and stringers 106.

Referring again to FIG. 1, the drum 32 is mounted within the exoskeleton 100 such that the front support 102 is located adjacent a front drum wall 52 and wherein at least a portion of the front support 102 is axially in front of an open front of the drum 32 on the front drum wall 52. The rear support 104 is located adjacent a rear drum wall 54 wherein at least a portion of the rear support 104 is axially behind of the rear drum wall 54. The drum may be rotatably mounted to the rear support 104 through the bearing mount 108. The stringers 106 extend between the front support 102 and rear support 104 and are located around the drum 32, exterior to the treating chamber 34.

The tub 28 at least partially surrounds the exoskeleton 100 and retains liquid within the liquid chamber 26. The tub 28 and front panel wall 14 enclose the front side of the liquid chamber 26. The rear support 104 and a flexible rear seal 31 coupled between a rear portion of the tub 28 and the rear support 104 enclose the rear side of the liquid chamber 26.

The tub 28 also includes a plurality of apertures defining suspension openings 29 between the interior 24 and the liquid chamber 26. The suspension openings 29 are aligned with the suspension system 30 such that the springs 70 and dampers 72 pass through the suspension openings 29 to couple the exoskeleton 100 to the chassis 12.

The electric motor 44 is mounted to the motor mount 112 on the rear side of the rear support 104 such that the electric motor 44 is physically supported by the rear support 104. The drive shaft 46 extends from the electric motor 44 through a bearing assembly mounted in the bearing mount 108 formed in the rear support 104 and is coupled to the rear drum wall 54 of the drum 32. The bearing assembly may comprise a friction reducing surface or friction reducing devices such as roller bearings and is configured to aid in rotation of the drive shaft 46 by reducing friction between the drive shaft 46 and the rear support 104.

The washing machine 10 may also include at least one counterweight 101 provided on the exoskeleton 100. The counterweight 101 may be coupled with the front support 102 or may be integrally formed with the front support 102. The density of the front support 102 may also be configured such that the front support 102 functions as a counterweight 101. Alternatively, the at least one counterweight 101 may be coupled to the stringers 106, or a combination of being attached to front support 102 and stringers 106.

Figure 4:
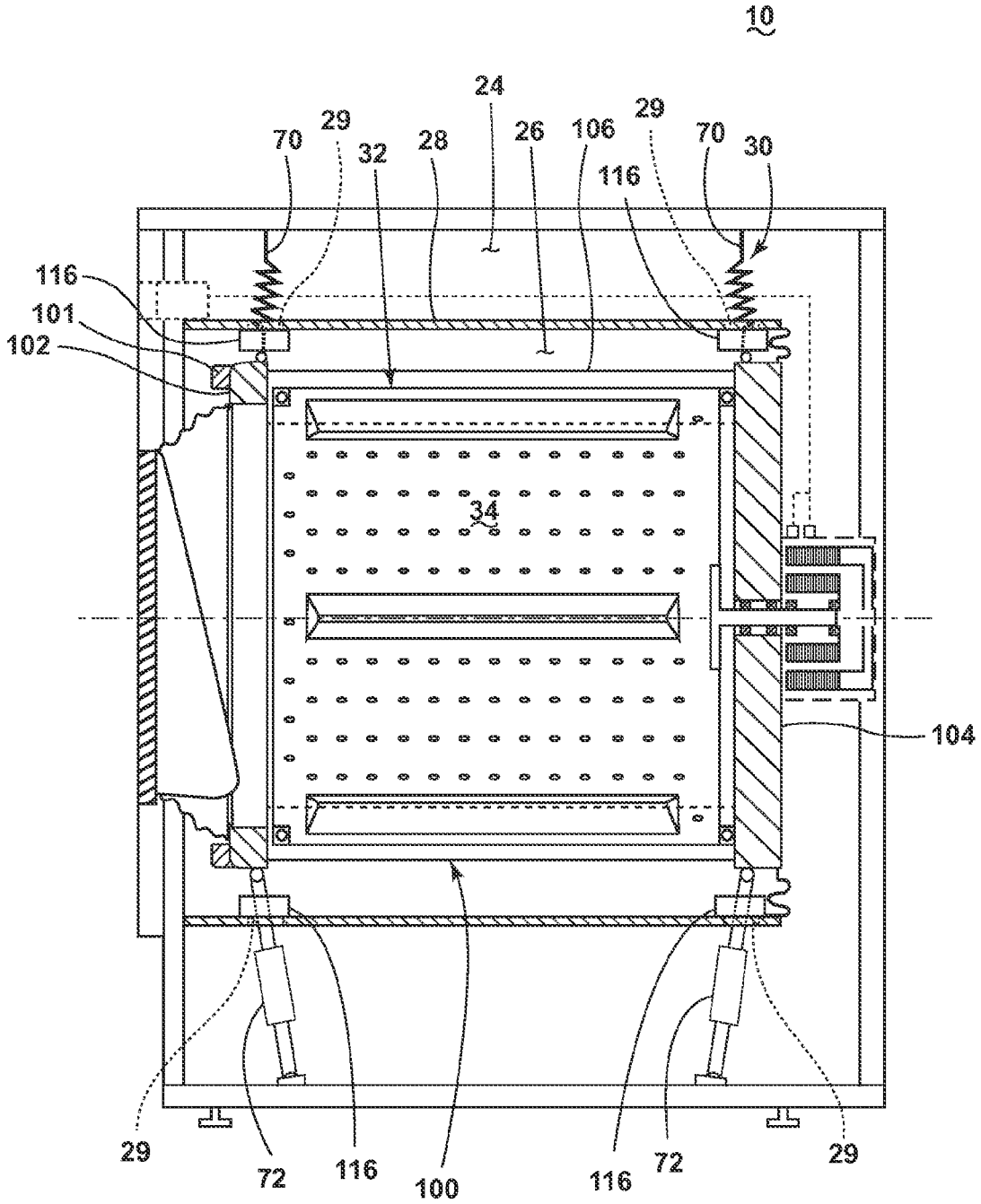
FIG. 4 is a schematic side view of a washing machine according to another embodiment of the invention.
Figure 5:
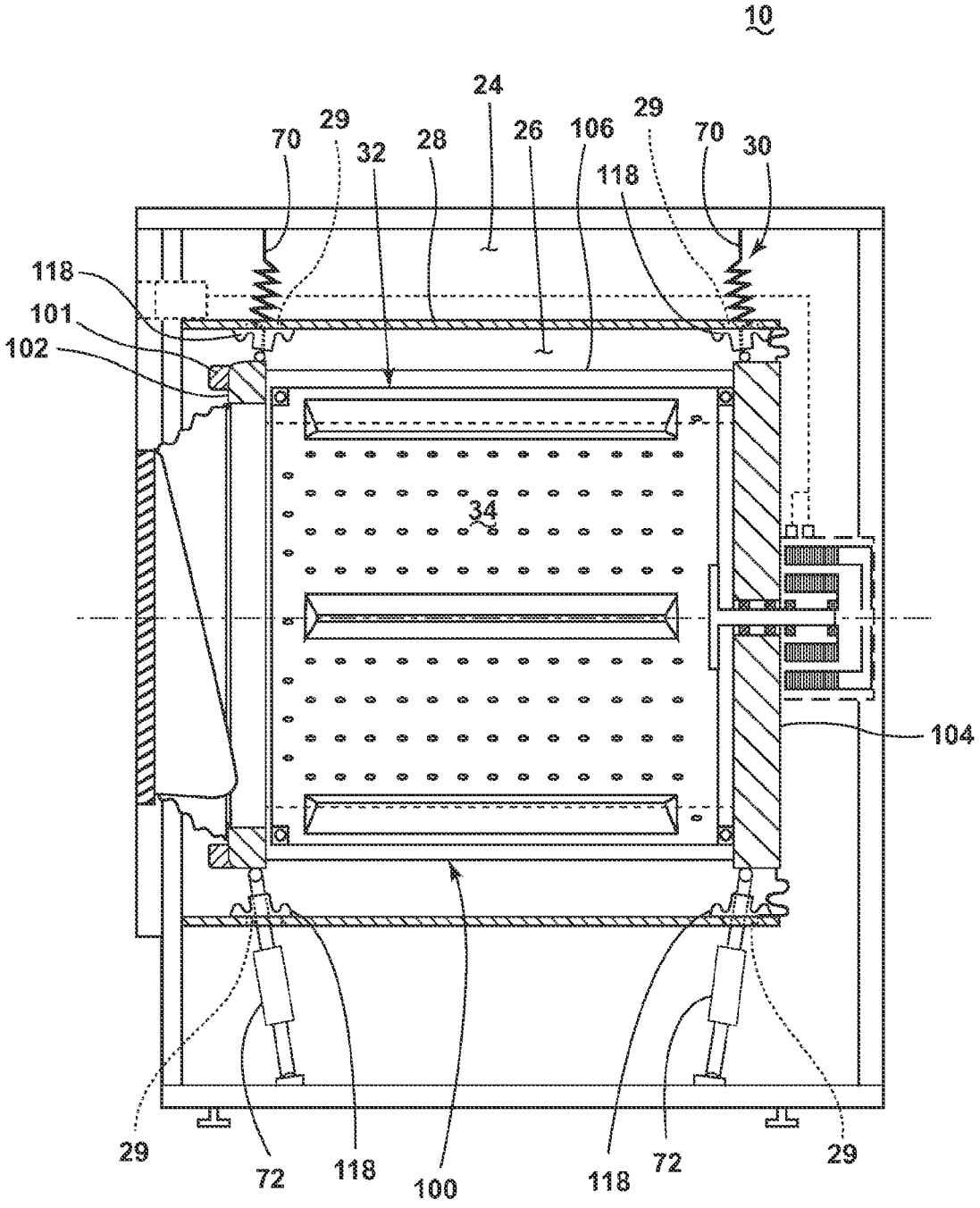
FIG. 5 is a schematic side view of a washing machine according to another embodiment of the invention.

Referring to FIG. 4, the tub 28 may also include a liquid dam, illustrated as raised walls 116, for at least retarding the flow of liquid from the liquid chamber 26 through the suspension openings 29. The raised walls 116 formed on or integrally with the tub 28, extend around the suspension openings 29 and towards the drum 32. In another embodiment shown in FIG. 5, the liquid dam may comprise flexible suspension seals 118 coupled between the suspension system 30 and the suspension openings 29. The flexible suspension seals 118 may be configured to tightly seal around the springs 70 or dampers 72 and the suspension opening 29 while still allowing for movement of the springs 70 or dampers 72.

The washing machine disclosed herein provides a plurality of benefits including that the size of the drum can be maximized to increase washing capacity of the drum without increasing a size of the chassis or cabinet. This is achieved by isolating the tub from the suspension system, supporting the drum with the exoskeleton and allowing the suspension system to extend between the exoskeleton and the chassis through the tub. Isolating the tub from the suspension system eliminates the clearance needed between a moving tub and the chassis. Extending the suspension system through the tub minimizes the space needed between the tub and the chassis to house the suspension system. Supporting the drum generated forces with the exoskeleton allows the tub to function solely as a liquid retainer and not as a structural support for the drum which also allows the tub wall thickness to be reduced. Eliminating clearances needed between the tub and the chassis, minimizing interior space needed to house the suspension system, and reducing the tub wall thickness allow for a larger drum with increase washing capacity without increasing a size of the chassis or cabinet While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A laundry treating appliance configured to treat laundry according to a treating cycle of operation, comprising:

a chassis defining an interior and having a front and a rear with an access opening located in the front;

a tub statically mounted to the chassis and defining a liquid chamber located within the interior and having at least one suspension opening in a side of the tub;

an exoskeleton located within the liquid chamber and having a front support located near the front of the chassis, a rear support located near the rear of the chassis, and stringers extending between and connecting the front and rear supports to collectively form a skeletal frame defining a frame interior;

an electric motor mounted to the rear support and having a rotating output shaft;

a drum located within the liquid chamber and connected to the output shaft such that rotation of the output shaft rotates the drum within the liquid chamber, the drum rotatably mounted to the exoskeleton; and a suspension system located within the interior and having at least one suspension component extending from the interior and into the liquid chamber through the suspension opening and operably coupled to the exoskeleton;

wherein the suspension system provides suspension directly to the exoskeleton to indirectly provide suspension for the drum and electric motor.

2. The laundry treating appliance of claim 1 wherein the rotatable drum is directly mounted to the rear support.

3. The laundry treating appliance of claim 2 wherein the at least one suspension component is coupled to the rear support.

4. The laundry treating appliance of claim 3 wherein the rear support comprises a bearing mount defining a shaft passage and a motor mount, wherein the electric motor is mounted to the motor mount such that the output shaft extends through the shaft passage.

5. The laundry treating appliance of claim 4 wherein the electric motor is on one side of the rear support and the drum is on an opposing side of the rear support.

6. The laundry treating appliance of claim 1 wherein the front support comprises a counter weight.

7. The laundry treating appliance of claim 1 wherein at least a portion of the front support is axially in front of an open front of the drum.

8. The laundry treating appliance of claim 1 wherein the front support is not coupled to the drum.

9. The laundry treating appliance of claim 1 wherein the chassis comprises panels.

10. The laundry treating appliance of claim 9 wherein at least a portion of the tub is either mounted to at least a portion of the panels or integrally formed with the panels.

11. The laundry treating appliance of claim 1 further comprising a liquid dam at least retarding a flow of liquid from the liquid chamber through the suspension opening.

12. The laundry treating appliance of claim 11 wherein the liquid dam comprises a seal between the at least one suspension component and the tub.

13. The laundry treating appliance of claim 1 wherein the at least one suspension component comprises at least one of a damper, strut, or spring.

14. The laundry treating appliance of claim 1 wherein the at least one suspension component is coupled to at least one of the front or rear supports.

15. The laundry treating appliance of claim 1 wherein the at least one suspension component comprises at least two suspension components, with one of the at least two suspension components coupled to the front support and the other of the at least two suspension components is coupled to the rear support.

16. The laundry treating appliance of claim 1 wherein the at least one suspension component is coupled to at least one of the front support, rear support, or stringer.

* * * * *